US008419216B2

(12) United States Patent
Wu

(10) Patent No.: US 8,419,216 B2
(45) Date of Patent: Apr. 16, 2013

(54) LED ILLUMINATION APPARATUS

(75) Inventor: Yu-Chia Wu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 304 days.

(21) Appl. No.: 12/939,172

(22) Filed: Nov. 4, 2010

(65) Prior Publication Data

US 2012/0099315 A1 Apr. 26, 2012

(30) Foreign Application Priority Data

Oct. 21, 2010 (TW) ..... 99135871 A

(51) Int. Cl.
*F21V 21/00* (2006.01)

(52) U.S. Cl.
USPC ..... 362/249.02; 362/613; 362/97.3; 362/311.02

(58) Field of Classification Search ..... 362/249.02, 362/613, 97.3, 311.02
See application file for complete search history.

(56) References Cited

U.S. PATENT DOCUMENTS

| | | | | |
|---|---|---|---|---|
| 8,075,163 | B2 * | 12/2011 | Xiao et al. | 362/287 |
| 2011/0141745 | A1 * | 6/2011 | Gu et al. | 362/311.02 |
| 2012/0081899 | A1 * | 4/2012 | Yu | 362/249.02 |
| 2012/0087110 | A1 * | 4/2012 | Lee | 362/97.3 |

FOREIGN PATENT DOCUMENTS

| | | | |
|---|---|---|---|
| CN | 101526185 | A | 9/2009 |
| CN | 101761824 | A | 6/2010 |
| TW | 201011201 | A | 3/2010 |

* cited by examiner

*Primary Examiner* — Evan Dzierzynski
(74) *Attorney, Agent, or Firm* — Altis Law Group, Inc.

(57) ABSTRACT

An LED illumination apparatus includes a shell, a fixing module, and at least one LED module fixed in the shell by the fixing module, wherein the fixing module includes a fastening piece and a tenon fixing respectively the two ends of the at least one LED module. The fastening piece includes a base fixed on the shell and a locking arm connecting to the base, and one end of the at least one LED module is fixed by one free end of the locking arm attached to the base.

10 Claims, 8 Drawing Sheets

LED ILLUMINATION APPARATUS

BACKGROUND

1. Technical Field

The disclosure relates to LED illumination, and particularly to an LED illumination apparatus.

2. Description of the Related Art

LEDs' many advantages, such as high luminosity, low operational voltage, low power consumption, compatibility with integrated circuits, easy driving, long term reliability, and environmental friendliness have promoted their wide use as a light source. Now, LEDs are commonly applied in environmental lighting.

Commonly used indoor LED illumination apparatus has a shell, a plurality of light emitting diodes inside the shell and a cover. The light emitting diodes and cover are usually fixed on the shell by a screw and a screw aperture. This is not convenient for assembly and disassembly. In a restricted environment such as a manufacturing clean room, disassembly will not be possible, since the process can generate contaminants.

Therefore, it is desirable to provide an LED illumination apparatus which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED illumination apparatus. Moreover, in the drawings, like reference numerals designate corresponding parts throughout the views.

DETAILED DESCRIPTION

Embodiments of an LED illumination apparatus as disclosed are described in detail here with reference to the drawings.

Figure 1:
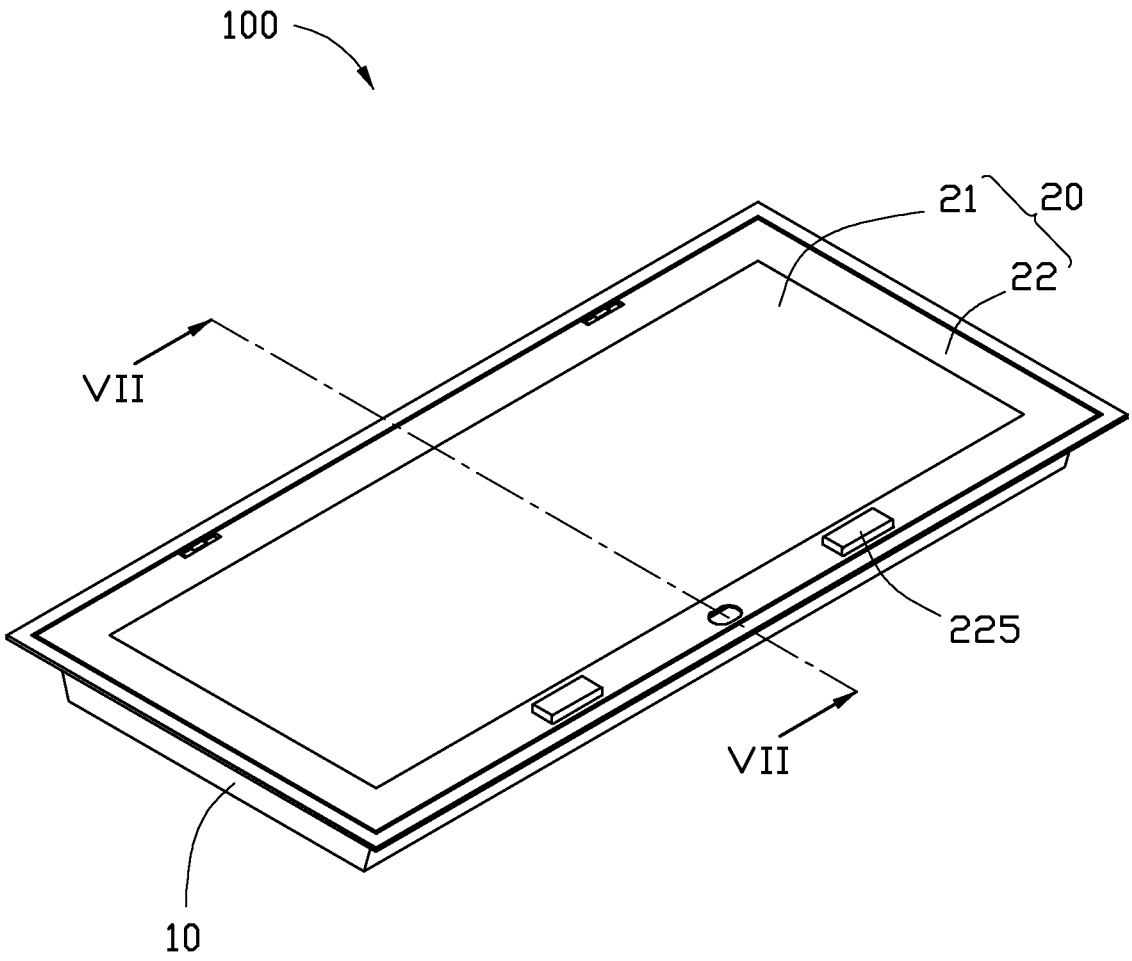
FIG. 1 is a schematic view of an LED illumination apparatus in accordance with a first embodiment.
Figure 2:
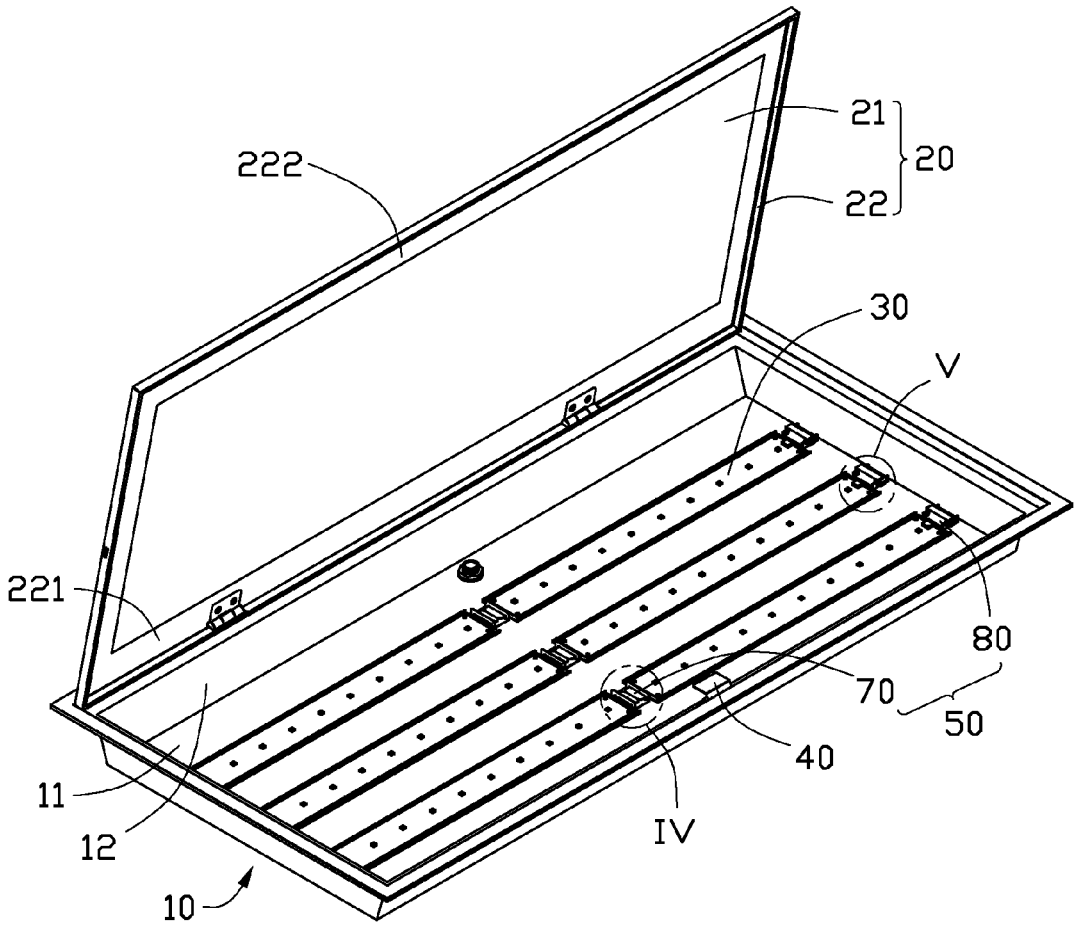
FIG. 2 is a schematic view of the LED illumination apparatus of FIG. 1 in an open position.

Referring to FIGS. 1 and 2, an LED illumination apparatus 100 includes a shell 10, a cover 20, a fastening mechanism 40, a plurality of LED modules 30, and a fixing module 50.

The shell 10 is made of material having good heat dissipation in order to dissipate heat from the LED module 30 through the shell 10 to the exterior. The shell 10 includes a bottom 11 and at least one sidewall 12. The bottom 11 can be circular, rectangular, or triangular, rectangular in this embodiment. The shell 10 includes four sidewalls 12. The bottom 11 and the sidewalls 12 define a recession (not labeled). The LED modules 30 are arranged in the recession. One end of the recession away from the bottom 11 has an opening. The sidewall 12 has a flange, and the shell 10 is embedded into a surface by the flange.

Figure 7:
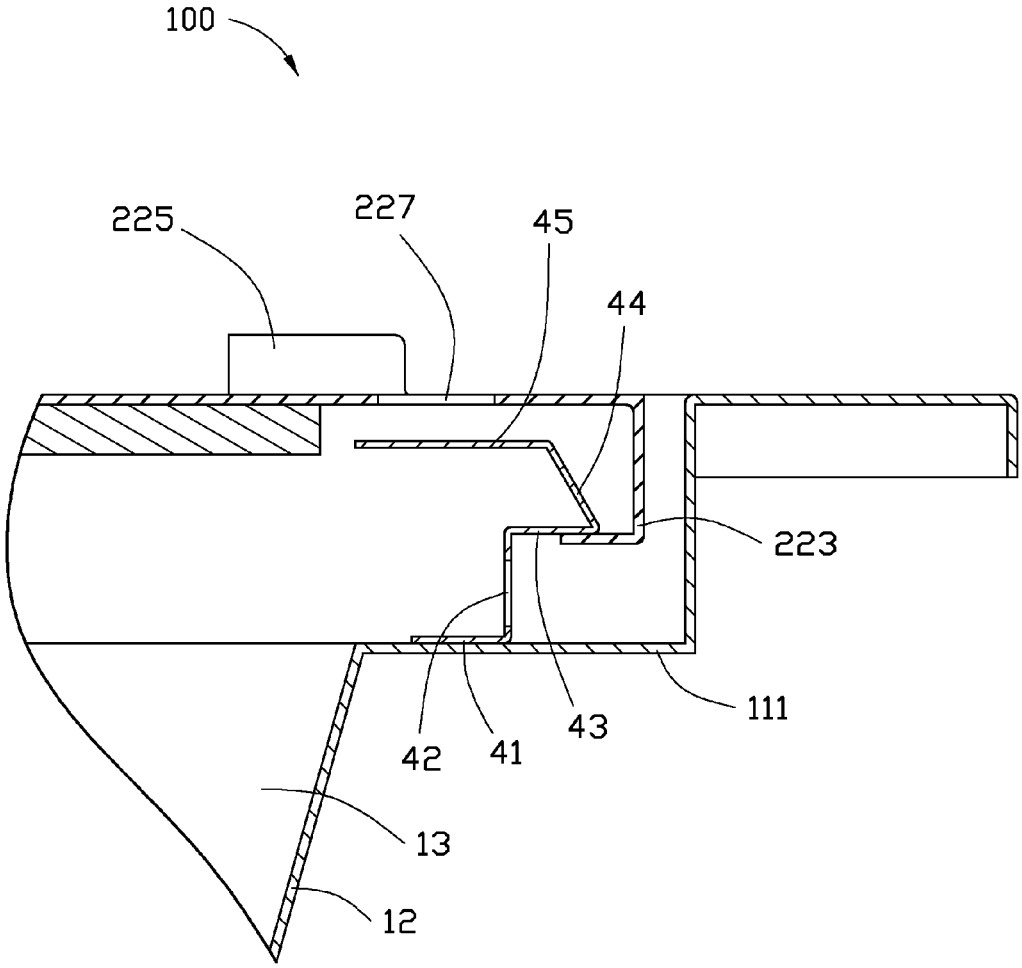
FIG. 7 is a cross section of a fastening mechanism of a cover of the LED illumination apparatus of FIG. 1 along line VII-VII thereof.

The cover 20 is arranged on the opening of the recession and corresponds in shape to the shell 10. In this embodiment, the cover 20 is rectangular including a transparent portion 21 surrounded by a frame 22. The frame 22 has a first edge 221 and a second edge 222 opposite to the first edge 221. The first edge 221 of the frame 22 pivots to the sidewall 12 of the shell 10, preferably by a hinge. The second edge 222 of the frame 22 forms a hook 223 extending to the bottom 11 of the shell 10 (as shown in FIG. 7).

The second edge 222 of the frame 22 forms at least one holding portion 225, by which a user can conveniently manipulate the cover 20 to open or close the cover 20. Preferably, the frame 22 is made of opaque material such as a metal sheet. Alternatively, the frame 22 and the transparent portion 21 can be formed in a piece by for example plastic injection molding.

Figure 3:
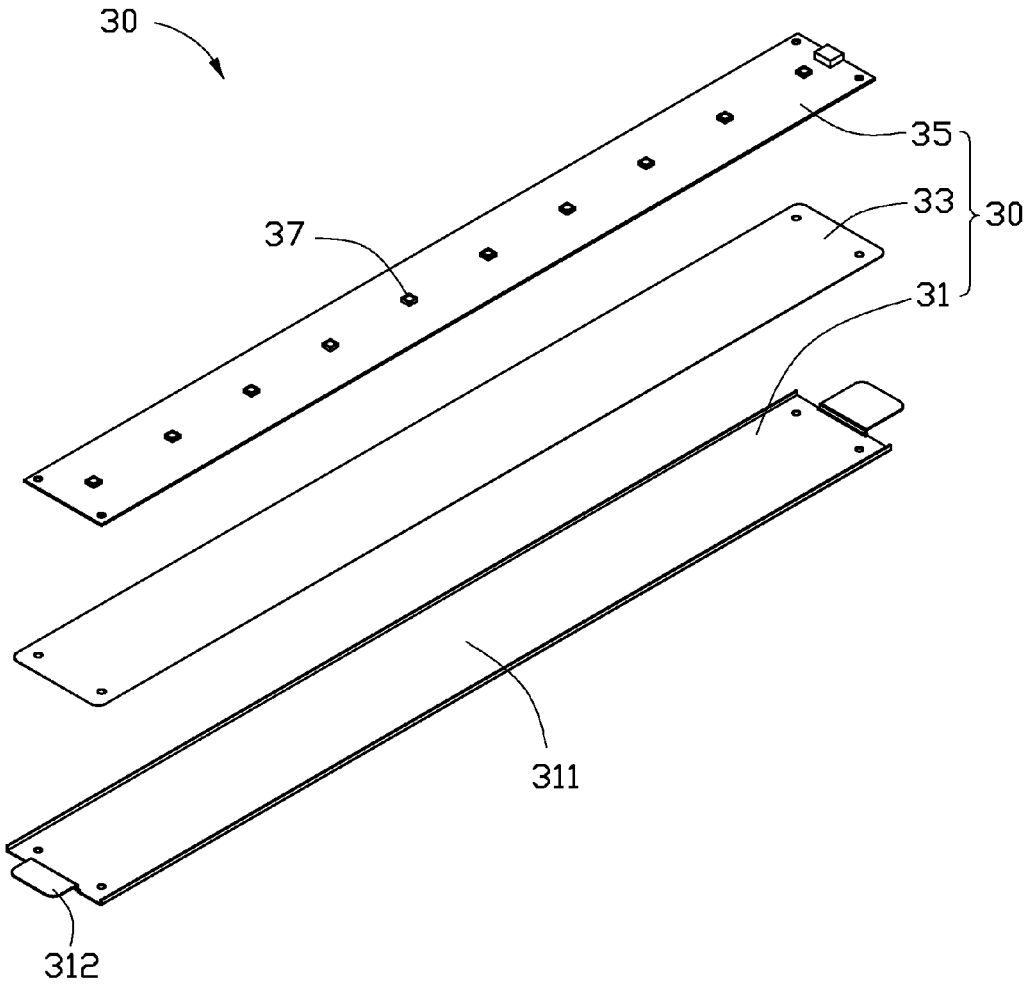
FIG. 3 is an exploded view of an LED module of FIG. 1.

As shown in FIG. 3, the LED modules 30 are arranged between the shell 10 and the cover 20. Six LED modules 30 are deployed in this embodiment, each two in a row with three rows. Each LED module 30 has a supporting board 31, an electrically insulating and heat dissipating board 33, a circuit board 35, and at least one light emitting diode 37 on the circuit board 35. The supporting board 31 includes a longitudinal main body 311 and an embedded portion 312. Each embedded portion 312 is a tab protruding upwardly from the main body 311 and horizontally outward.

The supporting board 31 is made of material having high strength and heat dissipation efficiency, such as aluminum. The electrically insulating and heat dissipating board 33 and the circuit board 35 corresponding to the shape of the supporting board 31 form a longitudinal shape, fixed on the main body 311 by fixing elements (not shown). The light emitting diodes 37 are arranged on the circuit board 35. In other embodiments, the electrically insulating and heat dissipating board 33 can be omitted, whereby the circuit board 35 is directly mounted on the supporting board 31.

Figure 4:
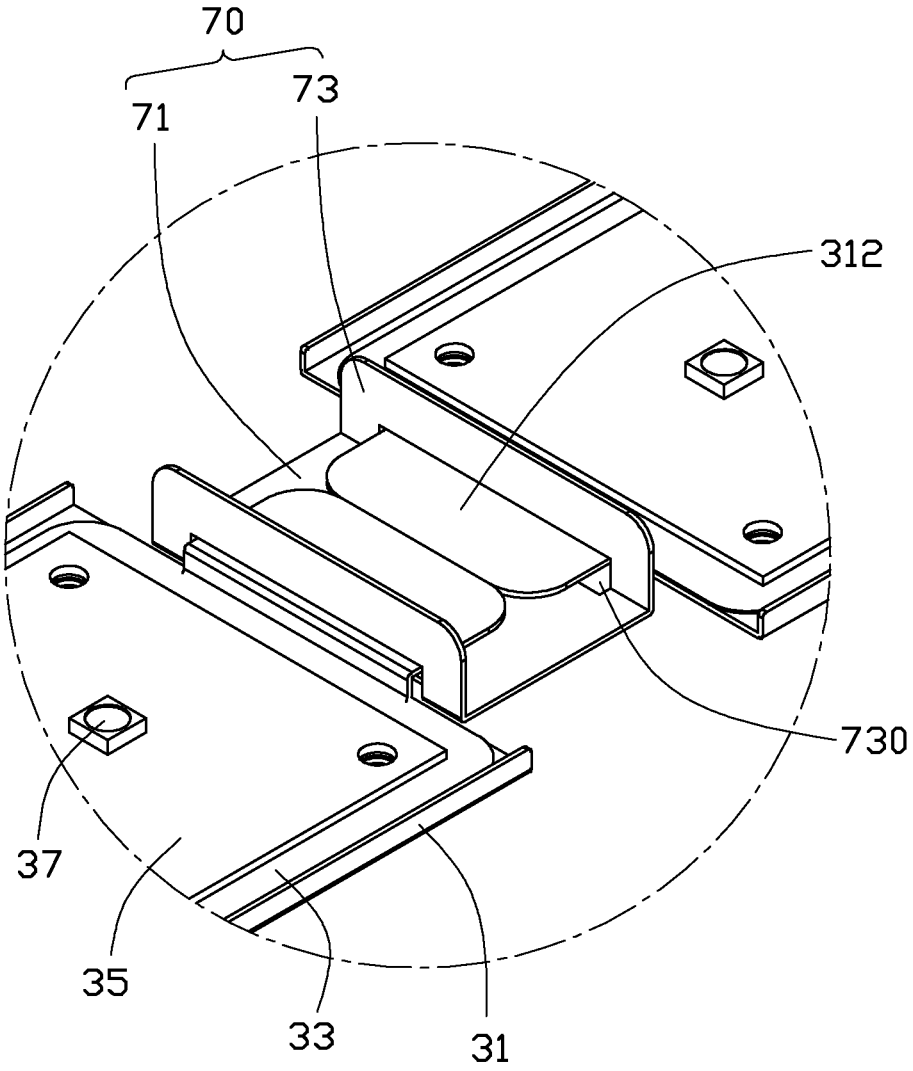
FIG. 4 is an enlarged view of an encircled portion IV of the LED illumination apparatus of FIG. 2.
Figure 5:
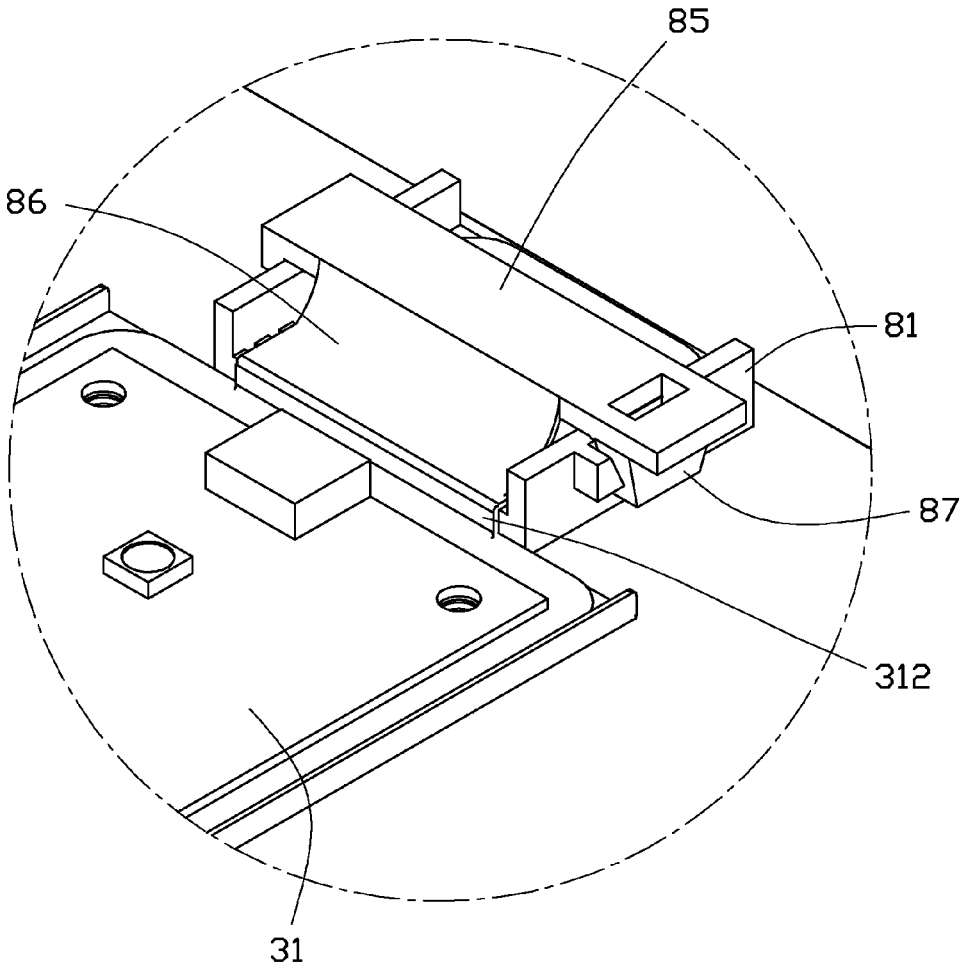
FIG. 5 is an enlarged view of an encircled portion V of the LED illumination apparatus of FIG. 2.
Figure 6:
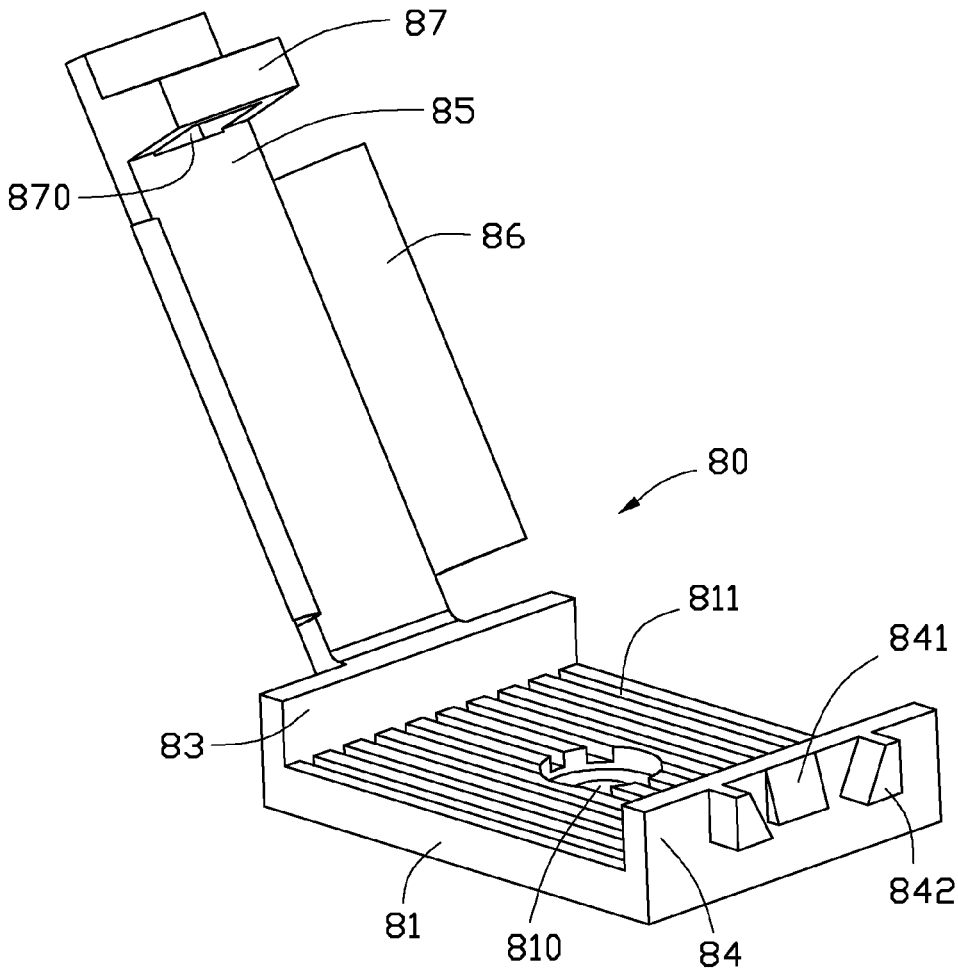
FIG. 6 is a schematic view of fastening piece of FIG. 2 in an open position.

Referring to FIGS. 4 to 6, a fixing module 50 includes a tenon 70 and a fastening piece 80 cooperatively fixing two ends of the LED modules 30 on the bottom 11 of the shell 10. Each tenon 70 includes a bottom plate 71 and two receiving portions 73 extending upwardly from the bottom plate 71 to two ends. Each receiving portion 73 defines a longitudinal hole 730 receiving the embedded portion 312. Each fastening piece 80 is arranged on the end of the LED module 30 opposite to the tenon 70. Thus, two ends of the LED module 30 are fixed by the fastening piece 80 and the tenon 70.

Each fastening piece 80 includes a base 81 and a locking arm 85 connected to the base 81. The free end of the locking arm 85 can fasten at the other side of the base 81 in order to fix one end of the LED module 30. The fastening piece 80 formed in a piece is made of plastic material in this embodiment.

The base 81 has a horizontal cavity 811 to increase the friction force between the base 81 and the LED module 30. Two ends of the base 81 respectively extend upwardly to form a connection wall 83 and a fixing wall 84. The locking arm 85 connects to center of the connection wall 83. The center of the base 81 has a fixing hole 810 for fixing elements to fix the base 81 on the bottom 11 of the shell 10.

A first protrusion 841 is formed on the outside wall of the fixing wall 84, and two second protrusions 842 are located at both sides of the first protrusion 841. The first protrusion 841 is a wedge. Thickness of the first protrusion 841 near the top of the fixing wall 84 is the smallest. Thickness of the first protrusion 841 gradually increases from the top of the fixing wall 84 to the center of the fixing wall 84. Each second protrusion 842 and the first protrusion 841 are separated and arranged in trapezoidal array. Each second protrusion 842 near a side of the first protrusion 841 has a sliding surface 843 inclining toward the first protrusion 841. The two opposite lateral sides of the locking arm 85 include two contact elements 86 toward the base 81. The free end of the locking arm 85 has a hook portion 87 toward the base 81. A receiving slot 870 is embedded inside the hook portion 87 and can be engaged with the first protrusion 841 mutually.

When the LED module 30 is arranged on the bottom 11 of the shell 10, the embedded portion 312 of the LED module 30 is received in the hole 730 of the tenon 70 fixed on the bottom 11. The other embedded portion 312 of the supporting board 31 contacts the base 81 of the fastening piece 80. Rotation of the locking arm 85 causes the fastening piece 80 to bias the embedded portion 312, and the hook portion 87 and the first protrusion 841 are fastened mutually. The contact element 86 of the locking arm 85 biases the embedded portion 312 of the LED module 30 which is fixed accordingly.

Figure 8:
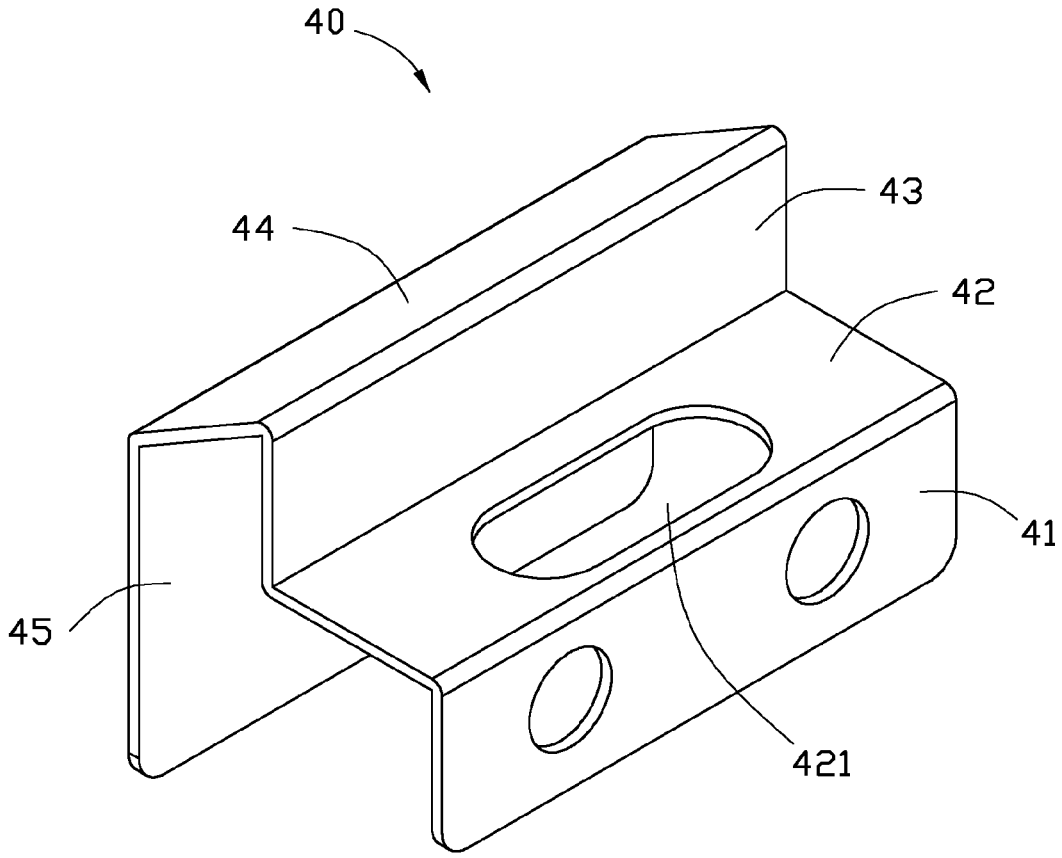
FIG. 8 is a schematic view of the fastening mechanism of the cover of FIG. 2.

Referring to FIGS. 7 and 8, the fastening mechanism 40 is arranged on the sidewall 12 of the shell 10. The cover 20 is fixed by the fastening mechanism 40 and the hook 223. In this embodiment, the fastening mechanism 40, an elastic piece, includes a fixing portion 41, a first connection portion 42, a buckle portion 43, a second connection portion 44 and a contact portion 45. Preferably, the fixing portion 41, the first connection portion 42, the buckle portion 43, the second connection portion 44 and the contact portion 45 are formed in a piece.

The fixing portion 41 is fixed on the sidewall 12 of the shell 10. In this embodiment, the sidewall 12 has a platform 111 parallel to the bottom 11. The fixing portion 41 is fixed on the platform 111. The first connection portion 42 extends from one end of the fixing portion 41 away from the bottom 11.

The first connection portion 42 is perpendicular to the platform 111. The first connection portion 42 has a first side toward the first edge 221 of the cover 20 and a second side opposite to the first side. The contact portion 45 has an inner portion extending inwardly beyond the first side of the first connection portion 41. The buckle portion 43 is arranged in front of the second side of the first connection portion 42. An inner end of the buckle portion 43 connects to a top end of the first connection portion 42. An outer end of the buckle portion 43 connects to a bottom end of the second connection portion 44. The second connection portion 44 extends upwardly and inwardly to connect with an outer end of the contact portion 45.

The buckle portion 43 is used for fastening with the hook 223 of the cover 20. The included angle between the buckle portion 43 and the first connection portion 42 ensures that the buckle portion 43 could lock the hook 223. In this embodiment, the buckle portion 43 is perpendicular to the first connection portion 42. Preferably, the angle between the buckle portion 43 and the second connection portion 44 is an acute angle. Thus, the buckle portion 43 of the cover 20 easily fastens with the hook 223.

The frame 22 corresponding to the contact portion 45 has a through hole 227 through which the contact portion 45 can be accessed. Thus, the first connection portion 42 will deform when a tool is inserted through the hole 227 to depress the contact portion 45, and then the buckle portion 43 of the cover 20 and the hook 223 will separate. The cover 20 is opened conveniently. In order to reduce the pressure needed for applying on the contact portion 45 to open the cover 20, the first connection portion 42 has an opening 421 in this embodiment. Because the contact portion 45 is inside the cover 20, it can avoid the cover 20 opening under abnormal situation.

In this embodiment, the two ends of the LED module 30 are respectively fixed by the tenon 70 and the fastening piece 80 of the fixing module 50. Thus, user could easily assemble and disassemble the LED module 30 and avoid dust entering the clean room.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED illumination apparatus, comprising:

a shell, a fixing module, and at least one LED module fixed in the shell by the fixing module, wherein the fixing module includes a fastening piece and a tenon fixing respectively the two ends of the at least one LED module, the fastening piece includes a base fixed on the shell and a locking arm connecting to the base, one end of the at least one LED module is fixed by one free end of the locking arm snapped with the base;

wherein the at least one LED module includes a supporting board, a circuit board arranged on the supporting board and at least one light emitting diode fixed on the circuit board, and the supporting board includes two opposite embedded portions for respectively embedding in the tenon and fastening piece.

2. The LED illumination apparatus of claim 1, wherein the tenon includes a bottom fixed on the shell and a receiving portion having a through hole for inserting one of the embedded portions of the supporting board.

3. The LED illumination apparatus of claim 1, wherein the supporting board is made of metal, an electrically insulating and heat dissipating board is arranged between the supporting board and the circuit board, the heat from the light emitter diode transmits to the shell through the electrically insulating and heat dissipating board.

4. The LED illumination apparatus of claim 1, wherein the fastening piece is formed in a piece and made of plastic material.

5. The LED illumination apparatus of claim 1 further comprising a cover and a cover fixing mechanism, wherein the cover includes a hook, the fastening mechanism includes a fixed portion, a buckle portion, and a contact portion, the buckle portion fastens the hook, and when pressing the contact portion, the buckle portion will deform, and then the buckle portion of the cover and the hook will separate.

6. The LED illumination apparatus of claim 5, wherein the cover has two opposite side edges, one side edge connects to the shell by the fastening mechanism, and the other side edge connects pivotally to the shell.

7. An LED illumination apparatus comprising:

a shell, a fixing module, and at least one LED module fixed in the shell by the fixing module, wherein the fixing module includes a fastening piece and a tenon, the tenon includes two receiving portions arranged in two opposite ends, each receiving portion corresponding to one end of the at least one LED module, each fastening piece includes a base connected to the shell, and a locking arm connected to the base, the other end of the LED module is fixed by one free end of the locking arm snapped with the base.

8. The LED illumination apparatus of claim 7, wherein a first protrusion is arranged at one side of the base of the fastening piece, two second protrusions are located at both sides of the first protrusion, one end of the locking arm has a hooking portion toward the base, a receiving slot is embedded inside the hooking portion for engaging with the first protrusion.

9. The LED illumination apparatus of claim 8, wherein the LED module includes a supporting board, a circuit board arranged on the supporting board and a plurality of light emitting diodes arranged on the circuit board, and the supporting board includes two opposite embedded portions for respectively embedding in the tenon and fastening piece.

10. An LED illumination apparatus, comprising:

a shell, a fixing module, and at least one LED module fixed in the shell by the fixing module, wherein the fixing module includes a fastening piece and a tenon fixing respectively the two ends of the at least one LED module, the fastening piece includes a base fixed on the shell and a locking arm connecting to the base, one end of the at least one LED module is fixed by one free end of the locking arm snapped with the base; and a cover and a cover fixing mechanism, wherein the cover includes a hook, the fastening mechanism includes a fixed portion, a buckle portion, and a contact portion, the buckle portion fastens the hook, and when pressing the contact portion, the buckle portion will deform, and then the buckle portion of the cover and the hook will separate.

* * * * *